US008013760B2

(12) United States Patent
Turnock et al.

(10) Patent No.: US 8,013,760 B2
(45) Date of Patent: Sep. 6, 2011

(54) HIGH OCCUPANCY VEHICLE STATUS SIGNALING USING ELECTRONIC TOLL COLLECTION INFRASTRUCTURE

(75) Inventors: Richard Turnock, Toronto (CA); Japjeev Kohli, Waterloo (CA)

(73) Assignee: Mark IV IVHS, Inc., Mississauga, Ontario (CA)

( * ) Notice: Subject to any disclaimer, the term of this patent is extended or adjusted under 35 U.S.C. 154(b) by 330 days.

(21) Appl. No.: 12/421,404

(22) Filed: Apr. 9, 2009

(65) Prior Publication Data

US 2010/0085213 A1 Apr. 8, 2010

Related U.S. Application Data

(60) Provisional application No. 61/102,911, filed on Oct. 6, 2008.

(51) Int. Cl.
*G08G 1/00* (2006.01)

(52) U.S. Cl. ..... 340/928; 340/936; 340/907; 340/905; 340/572.1; 340/572.4; 340/572.7; 340/10.1

(58) Field of Classification Search ..... 340/928, 340/936, 907, 905, 572.1, 572.4, 572.7, 10.1
See application file for complete search history.

(56) References Cited

U.S. PATENT DOCUMENTS

| | | | | |
|---|---|---|---|---|
| 5,675,342 | A * | 10/1997 | Sharpe | 340/10.2 |
| 6,219,613 | B1 | 4/2001 | Terrier et al. | |
| 6,661,352 | B2 | 12/2003 | Tiernay et al. | |
| 7,388,501 | B2 | 6/2008 | Tang et al. | |
| 2006/0044161 | A1 * | 3/2006 | Feldman et al. | 340/933 |
| 2010/0026465 | A1 | 2/2010 | Gravelle et al. | |

OTHER PUBLICATIONS

Capital Beltway, Interstate 495 Virginia HOT Lanes, FAQ document, 2 pages, (estimated 2006).
Legislative Information, Chapter 167, An Act to amend and reenact §§ 33.1-56.1 and 33.1-56.3 of the Code of Virginia, relating to HOT lanes enforcement, 4 pages, Mar. 3, 2008.

* cited by examiner

*Primary Examiner* — Tai T Nguyen
(74) *Attorney, Agent, or Firm* — Hanley, Flight & Zimmerman

(57) ABSTRACT

An electronic toll collection system, reader, method and transponder for communicating occupancy status. The vehicle-mounted transponder includes a selection device that permits a user to select between a normal and high occupancy state. The transponder reports its occupancy status to a reader. If the electronic toll collection system processes a toll transaction and the transponder claims high occupancy status during the toll transaction, the fact that high occupancy status was claimed during the transaction is recorded in memory within the transponder for later enforcement and verification purposes.

20 Claims, 5 Drawing Sheets

HIGH OCCUPANCY VEHICLE STATUS SIGNALING USING ELECTRONIC TOLL COLLECTION INFRASTRUCTURE

CROSS-REFERENCE TO RELATED APPLICATIONS

The present application claims priority to U.S. provisional application Ser. No. 61/102,911 filed Oct. 6, 2008, and owned in common herewith.

FIELD

The present application relates to electronic toll collection systems and methods and, in particular, to differentiated tolling based on high occupancy status.

BACKGROUND

Road congestion is a common problem on modern roadways. To relieve or prevent congestion many levels of government encourage car pooling. One common mechanism for encouraging car pooling is designating one or more lanes on a multilane roadway as "high occupancy" lanes, meaning they can only be used by vehicles containing more than a minimum number of occupants.

Another mechanism that can be used when trying to encourage car pooling on toll highways is "high occupancy tolling", which means those vehicles that meet the threshold minimum number of occupants pay a lower toll amount than those vehicles that do not. Accordingly, drivers are encouraged to car pool because they will enjoy reduced toll charges.

A difficulty arises in determining how to charge differentiated toll amounts. In the context of a gated toll highway, where each vehicle must stop at a toll booth and present payment, it is easy for the toll booth operator to determine the number of occupants and charge the appropriate toll amount. However, most toll roadways are now at least partly electronic. In some cases, the toll roadways have no gated toll lanes because the system is entirely electronic. These may be referred to as "open road" electronic toll collection systems.

Electronic toll collection systems conduct toll transactions electronically using RF communications between a vehicle-mounted transponder (a "tag") and a stationary toll plaza transceiver (a "reader"). An example of an electronic toll collection system is described in U.S. Pat. No. 6,661,352 issued Dec. 9, 2003 to Tiernay et al. Another example is described in U.S. Pat. No. 6,219,613 issued Apr. 17, 2001 to Terrier et al. The contents of U.S. Pat. Nos. 6,661,352 and 6,219,613 are hereby incorporated by reference.

In a typical electronic toll collection (ETC) system, a set of antennas is disposed to cover the roadway with overlapping coverage zones. Each antenna broadcasts a wakeup or trigger RF signal within its coverage zone. A tag on a vehicle passing through the coverage area or zone detects the wakeup or trigger signal and responds with its own RF signal. The tag responds by sending a response signal containing information stored in memory in the transponder, such as the transponder ID number. The response signal is received by the antenna.

The antennas operate under the control of a roadside reader that typically multiplexes in time or frequency to scan the roadway for transponders. When an antenna receives a response signal, the response signal is input to the reader, which may then conduct an electronic toll transaction, such as by debiting a user account associated with the transponder ID number. The reader may then cause the antenna to broadcast a programming RF signal to the tag. The programming signal provides the tag with updated information for storage in its memory. For example, the tag may be provided with a passage record update, which is information regarding the most recent toll plaza or entry/exit point traversed by the tag. For instance, a location, identifier or other information regarding the current reader may be recorded and/or a time stamp.

In U.S. Pat. No. 7,388,501, issued Jun. 17, 2008 to Tang et al., it was suggested that the ETC system may be leveraged to charge differentiated tolls based on high occupancy status of a vehicle. Tang et al. suggested that high occupancy status could be communicated from a vehicle to a roadside reader by sending a differently polarized transponder response signal to the roadside reader.

It would be advantageous to provide for an improved transponder, ETC system, and/or methods of operating the ETC system that facilitate high occupancy tolling.

BRIEF SUMMARY

The present application discloses an electronic toll collection system, method and transponder for communicating occupancy status. The vehicle-mounted transponder includes a selection device that permits a user to select between a normal and high occupancy state. The transponder reports its occupancy status to a reader. If the electronic toll collection system processes a toll transaction and the transponder claims high occupancy status during the toll transaction, the fact that high occupancy status was claimed during the transaction is recorded in memory within the transponder for later enforcement and verification purposes.

In one aspect, the present application provides an electronic toll collection transponder for use in an electronic toll collection system for communicating high occupancy status to a reader. The transponder includes a controller; a memory storing transponder information; a selection device to select a high occupancy state; and a transceiver and antenna configured to, under control of the controller, receive a trigger signal, send a response signal to the reader in reply to the trigger signal, and receive a programming signal, wherein the response signal includes the transponder information and includes the high occupancy state selected via the selection device. The controller is configured to record a high occupancy claim indicator in the memory evidencing that the transponder claimed high occupancy state if the programming signal includes the high occupancy claim indicator.

In another aspect, the present application provides a method of communicating high occupancy status between a vehicle and a reader of an electronic toll collection system. The method includes receiving a user input selecting a high occupancy state via a selection device; receiving a trigger signal from the roadside reader and sending a response signal to the roadside reader, wherein the response signal includes transponder information and the high occupancy state selected via the selection device; receiving a programming signal, wherein the programming signal includes a high occupancy claim indicator; and recording the high occupancy claim indicator in memory evidencing that the transponder claimed the high occupancy state.

In yet another aspect, the present application provides electronic toll collection system for performing differentiated tolling for vehicles within a roadway. The system includes a reader, including a plurality of antennas defining a capture zone within the roadway, an RF transceiver, and a toll transaction processor for conducting electronic toll collection transactions; and a transponder. The transponder includes a controller a memory storing transponder information, a selection device operable by a user to select a high occupancy state, and a transceiver and antenna configured to, under control of the controller, receive a trigger signal, send a response signal to the reader in reply to the trigger signal, and receive a programming signal, wherein the response signal includes the transponder information and includes the high occupancy state selected via the selection device. The reader is configured to generate the programming signal containing updated transponder information, the updated transponder information including a high occupancy indicator based on the high occupancy state in the response signal. The controller is configured to overwrite the transponder information in memory with the updated transponder information received in the programming signal, thereby storing the high occupancy claim indicator.

In yet another aspect, the present application discloses a electronic toll collection reader for performing differentiated tolling for vehicles within a roadway, each vehicle having a transponder storing transponder information and being configured to send a response signal containing the transponder information and a high occupancy status. The reader includes a transceiver; one or more antennas for sending and receiving RF signals under the controller of the transceiver and defining a capture zone within the roadway; and a processor for controlling the transceiver. The processor is configured to cause the transceiver to transmit a trigger signal within the capture zone, receive the response signal in reply to the trigger signal, detect the high occupancy status within the transponder information in the response signal, initiate a toll transaction, generate updated transponder information including a high occupancy claim indicator, and cause the transceiver to transmit a programming signal containing the updated transponder information.

In yet a further aspect, the present application describes a method of conducting differentiated tolling for vehicles within a roadway, each vehicle having a transponder storing transponder information and being configured to send a response signal containing the transponder information and a high occupancy status when in a capture zone of a toll area, the toll area having a reader including antennas defining the capture zone. The method includes transmitting a trigger signal within the capture zone; receiving the response signal from the transponder in reply to the trigger signal; detecting the high occupancy status within the transponder information in the response signal; initiating a toll transaction; generating updated transponder information including a high occupancy claim indicator; and transmitting a programming signal to the transponder containing the updated transponder information.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show one or more embodiments of the present invention, and in which.

Similar reference numerals are used in different figures to denote similar components.

DESCRIPTION OF SPECIFIC EMBODIMENTS

Figure 1:
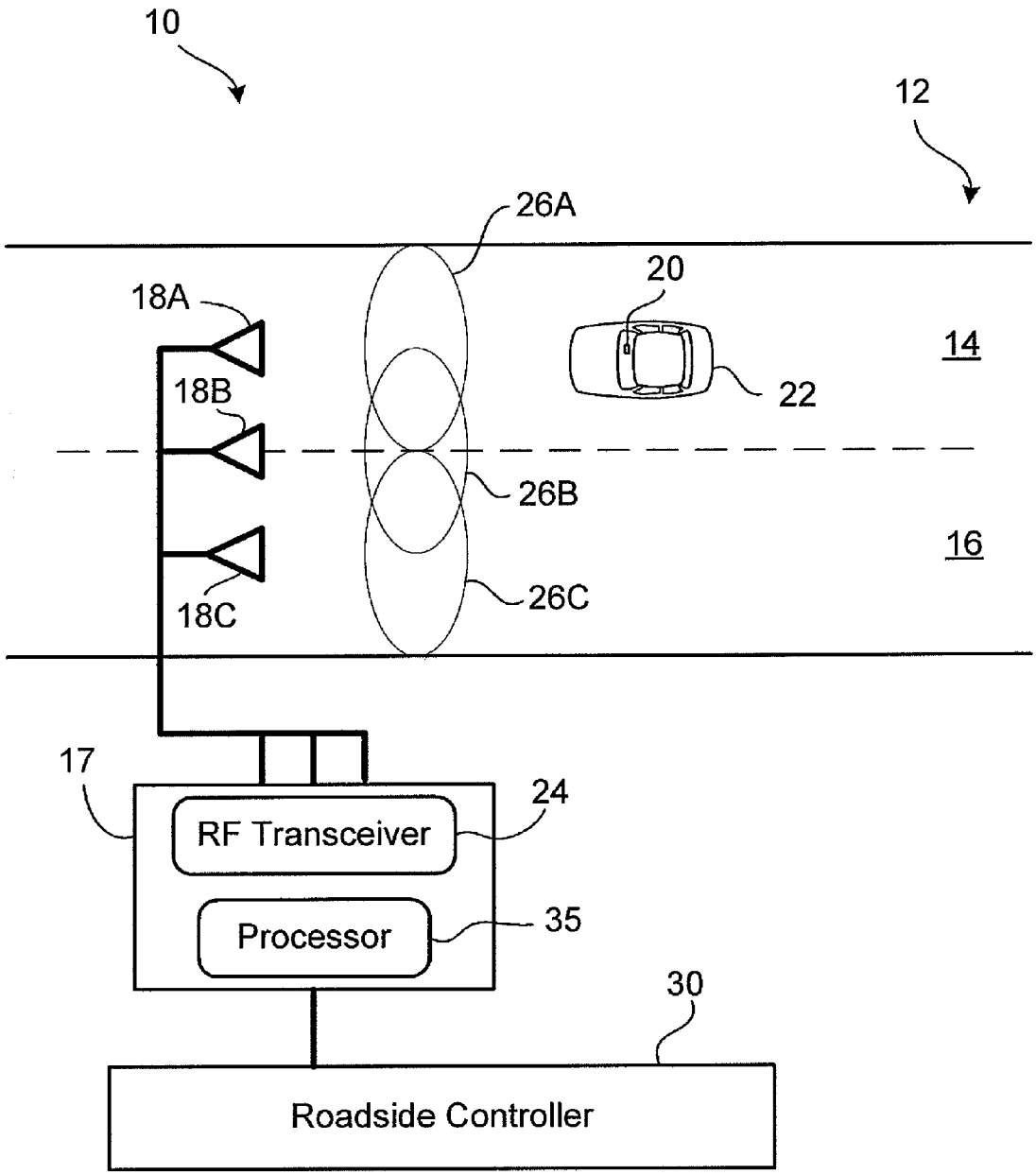
FIG. 1 shows a block diagram of an embodiment of an electronic toll collection (ETC) system.

Reference is first made to FIG. 1, which shows, in diagrammatic form, an electronic toll collection system 10. In this example embodiment, the electronic toll collection system 10 is used in connection with a roadway 12 having first and second adjacent lanes 14 and 16. It will be appreciated that in other embodiments the electronic toll collection system 10 may be used in connection with single lane roadways, multi-lane roadways, toll plazas, or other road configurations. The electronic toll collection system 10 may be used in a gated embodiment, wherein the vehicles enter a toll collection area and are signaled, such as by a gate or light, when they are permitted to proceed. The electronic toll collection system 10 may also be used in an open road embodiment, wherein the vehicles are not required to stop or slow down in the toll collection area.

The electronic toll collection system 10 includes a reader 17 connected to a set of antennas 18 (shown individually as 18A, 18B, and 18C). The reader 17 processes signals that are sent and received by the antennas 18, and includes a processor 35 and an RF transceiver 24. It will be understood that in other embodiments there may be more than one reader 17. In some embodiments, there may be a reader 17 for each antenna 18.

The RF transceiver 24 is configured to modulate signals from the processor 35 for transmission as RF signals over the antennas 18, and to de-modulate RF signals received by the antennas 18 into a form suitable for use by the processor 35. In this regard, the reader 17 employs hardware and signal processing techniques that are well known in the art. The processor 35 includes a programmable processing unit, volatile and non-volatile memory storing instructions and data necessary for the operation of the processor 35, and communications interfaces to permit the processor 35 to communicate with RF module 24 and a roadside controller 30.

The antennas 18 and reader 17 function to trigger or activate a transponder 20 (shown in the windshield of a car 22), to record transponder specific information, and to acknowledge to the transponder 20 that a validated exchange has taken place. The antennas 18 are directional transmit and receive antennas which, in the illustrated preferred embodiment, have an orientation such that each antenna 18 can only receive signals transmitted from a transponder when the transponder is located within a roughly elliptical coverage zone associated with the antenna. The antennas 18 are located above the roadway 12 and arranged such that the antenna 18A has a coverage zone 26A that extends across the first lane 14, antenna 18B has a coverage zone which extends from approximately the center of lane 14 to the center of lane 16, and the antenna 18C has a coverage zone 26C which extends across the entire width of the second lane 16. Each of the coverage zones 26A, 26B and 26C may be of an approximately elliptical shape and may cover an approximately similar sized area. Furthermore, the coverage zones 26A, 26B and 26C may be aligned side-by-side along an axis 28 that is orthogonal to the travel path along roadway 12. As is apparent from FIG. 1, the coverage zone 26A provides complete coverage of the first lane 14, and the coverage zone 26C provides complete coverage of the second lane 16. The coverage zone 26B overlaps both of the coverage zones 26A and 26C.

It will be understood that although the coverage zones 26A, 26B and 26C are illustrated as having elliptical shapes, in many embodiments the actual shapes of the coverage zones 26A, 26B and 26C will typically not be perfectly elliptical, but will have a shape that is dependent upon a number of factors, including RF reflections or interference caused by nearby structures, the antenna pattern and mounting orientation. Prior to operation of the ETC system 10, the actual approximate coverage shape and size of each of the coverage zones may be determined through well known mapping or approximation techniques, and stored by the processor 35 of the ETC system 10 such that the size, shape and location of each of the coverage areas 26A, 26B and 26C are generally known and predetermined by the system.

The reader 17 is connected to the roadside controller 30. The electronic toll collection system 10 may include an enforcement system, such as a vehicle imaging system (not shown). The imaging system may include an image processor connected a number of cameras arranged to cover the width of the roadway 12 for capturing images of vehicles. The image processor may be connected to and controlled by the roadside controller 30.

The electronic toll collection system 10 operates in accordance with a predefined communications protocol. The communications protocol may be an open protocol or a proprietary protocol. Suitable protocols may include various public TDMA protocols, the state, of California Code of Regulation (CALTRAN) Title 21 (T21) protocol, and the proprietary IAG (Inter-Agency Group) protocol.

It will also be appreciated that the communications within the electronic toll collection system may take place within any one or more of a number of frequency bands. For example, communications may occur in the 915 MHz band, 2.4 GHz band, and/or the 5.9 GHz DSRC (dedicated short range communications) band. The selection of a suitable frequency band may depend on the specific application and the presence of any legacy equipment in the system.

In one embodiment, the electronic toll collection system 10 operates in accordance with a communications protocol that specifies a read-program-verify cycle for communications. Under such a protocol, the tag or transponder 20 listens for a trigger or wake-up signal from the roadside reader 17. The reader 17 periodically broadcasts its trigger or wakeup signal within the coverage areas 26. When a tag or transponder 20 enters the coverage areas 26 and detects the trigger or wakeup signal from the reader 17, then the transponder 20 broadcasts a response signal. The response signal contains a block of information stored within a predefined area in the transponder memory. This block of information may be labelled "transponder information" in the discussion below. In many ETC systems, the transponder information includes transponder specific details such as a transponder identification number, a vehicle make or class, ownership or registration information, agency specific codes, and other such data. The transponder information may also include details of the most recent transaction, such as a reader ID and time stamp identifying the last transaction or entry point to a toll highway. The transponder information also typically includes error check fields.

A reader 17 receives the response signal from the transponder 20 via the antennas 18. The roadside controller 30 may then begin the process of conducting a toll transaction and creating an updated passage record. In some cases, the roadside controller 30 does not conduct a toll transaction involving a payment, for example if the roadside controller 30 is located at an entry point to the toll highway. In such a case, the roadside controller 30 may simply update the passage record, i.e. record the fact that the transponder 20 has entered the roadway. It may also send the transponder a signal instructing the transponder to record its entry point in memory, i.e. store the updated passage record in memory, as will be described below. In some instances, the roadside controller 30 may be at an intermediate point between ingress and egress points on the roadway.

In some instances, the reader 17 will read the transponder 20 multiple times while the vehicle 22 traverses the coverage area 26. That is, there will be multiple trigger-read cycles. Once the toll transaction has been completed by the roadside controller 30, it instructs the reader 17 to update the transponder information within the transponder 20. Accordingly, the reader 17 sends a programming signal to the transponder 20 instructing the transponder 20 to write information to its memory. For example, the reader 17 may instruct the transponder 20 to record an updated passage record, or overwrite the most recent transaction section of the transponder information stored in its memory. The reader 17 may then perform a subsequent read operation in order to verify that the transponder's memory has been successfully updated.

As used herein, the term "toll transaction" means initiating the calculation and/or payment of a toll. For the purposes of this application, the "toll transaction" may be considered complete when the reader 17 and/or roadside controller 30 have determined that a toll is payable and have initiated such a transaction. Even though additional steps, such as the debiting of an account, etc., may be required to obtain payment, once the roadside controller 30 and/or reader 17 have carried the toll transaction sufficiently far to send a programming signal to the transponder 20 in order to update the transponder memory, then the toll transaction may be considered complete for the purposes of this application. The toll transaction typically occurs at an egress point from the roadway or at least a tolled portion of the roadway. Note that the programming signal and the transponder memory do not necessarily contain any information regarding the toll payment and/or user account.

It will be appreciated that the reader 17 may send a programming signal instructing the transponder 20 to update its stored transponder information in circumstances other than following initiation of a toll payment. For example, the reader 17 may be located at an entry point and the programming signal may include information regarding the identity of the entry point. In some cases, the identity of the entry point may be used by a reader or roadside controller at an exit point to determine the amount of a toll payable. These types of operations may be referred to as updating "passage records". Accordingly, not all programming signals are indicative of a "toll transaction", as that term is used herein.

Existing toll highways may be relied upon to encourage carpooling by offering reduced toll rates to those vehicles having multiple occupants. With an electronic toll highway and, in particular, an open road electronic toll highway, it becomes difficult to differentiate between single occupant vehicles and multiple occupant vehicles in order to conduct differentiated tolling. In some cases the roadway 12 may have one or more lanes designated for high occupancy vehicles (HOV). These lanes may be marked to indicate that they are only for HOV use. They may or may not have a physical barrier separating them from the other lanes of the roadway 12. However, other roadways 12 may not have HOV lanes. In either case, the toll operator may wish to offer differentiated tolling. Accordingly, irrespective of whether there are HOV lanes, the roadway 12 may offer high occupancy tolling (HOT), which means different toll rates for high occupancy vehicles. The HOT feature may or may not be linked with travel in an HOV lane.

In accordance with the present application, the electronic toll collection system 10 permits the vehicle occupant to claim high occupancy status. A switch, button, or other user input device integral with, or connected to, the transponder 20 is used by the vehicle occupant to select between a normal or high occupancy state. If a high occupancy state is selected, it may then be reported to the reader 17 during a read operation and any consequent toll payment is conducted at the high occupancy toll rate instead of the normal toll rate. It will be appreciated that this process relies upon the user to properly report the occupancy status of the vehicle.

Figure 2:
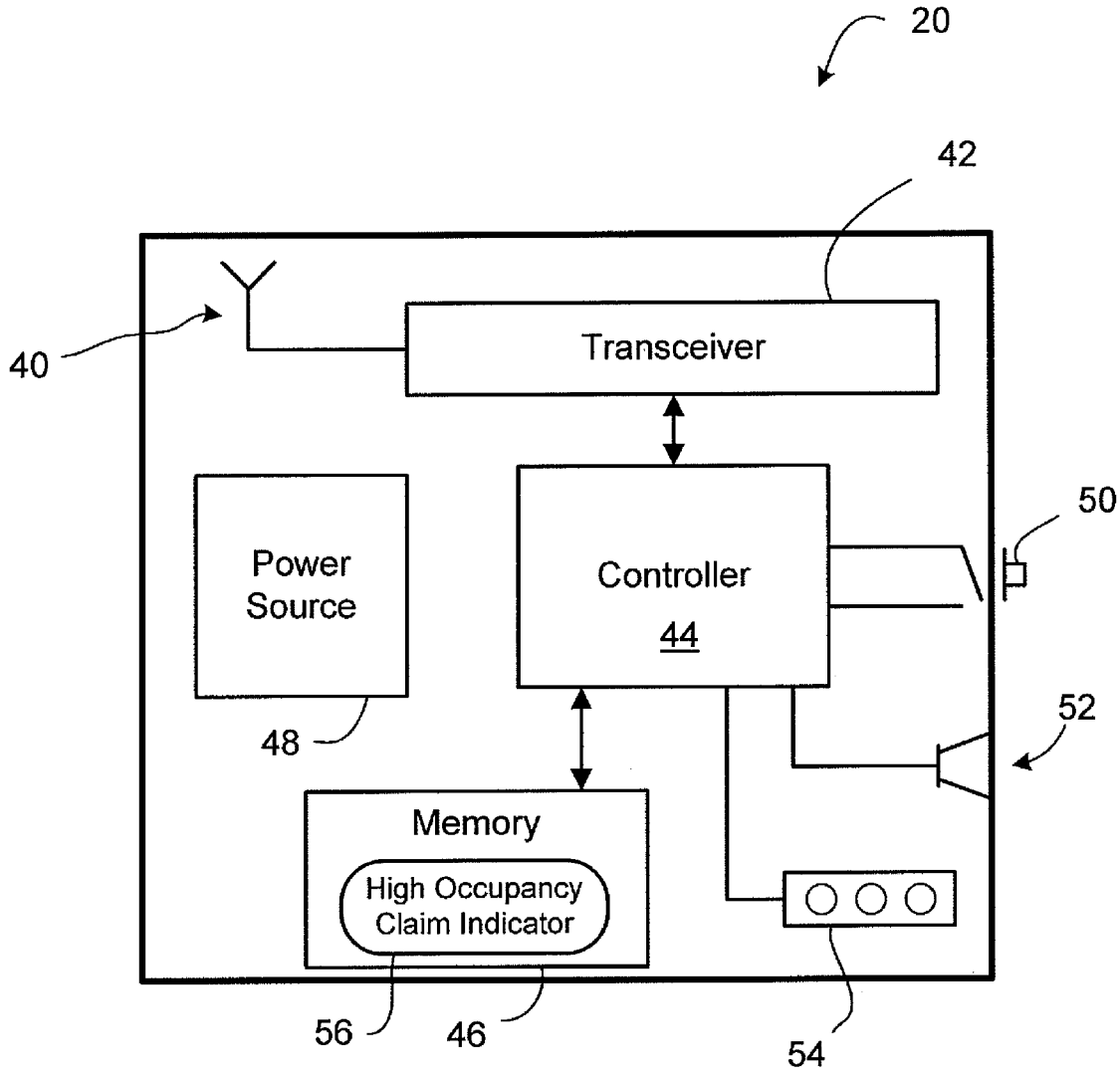
FIG. 2 shows a block diagram of an embodiment of a transponder for use in the ETC system.

Reference is now made to FIG. 2, which shows a, block diagram of an embodiment of the transponder 20.

The transponder 20 includes an RF transceiver 42 and antenna 40 for receiving and demodulating RF signals from a roadside reader or portable reader. The RF transceiver 42 and antenna 40 are also used to broadcast response signals. The transceiver 42 and antenna 40 operate under the control of a controller 44. The transponder 20 includes memory 46 within which it stores transponder information and other data. For example, the transponder 20 may store a high occupancy claim indicator 56, which evidences a claim having been made to high occupancy status during a toll transaction, as will be explained further below.

The transponder 20 may also include a power source 48, such as a battery, electromechanical power source, solar power source, wired connection to a vehicle power source, or the power supplied in the signal from the reader. The controller 44 may be implemented by way of a microprocessor, microcontroller, or application specific integrated circuit (ASIC). The suitable programming of the controller 44 to implement the functions described herein will be within the understanding of one of ordinary skill in the art. It will also be understood that in the case of a passive transponder, the "controller" 44 is implemented by simple passive circuitry powered by the signal supplied by the reader.

The transponder 20 also includes an input device, such as a pushbutton, switch, slide bar, or other selection device, generally indicated by a reference numeral 50. The selection device 50 is capable of at least indicating a selection between one of two states. In another embodiment (not shown), the transponder 20 may not include a distinct selection device 20, but rather it may communicate its high or normal occupancy state based on the polarization of its response signal, as described in U.S. Pat. No. 7,388,501.

In some embodiments, the transponder may also include a speaker 52 or other audio output device and a visual display device, such as one or more light emitting diodes (LEDs) 54.

In accordance with embodiments of the present application, the selection device 50 is used by an occupant of the vehicle to select between normal or high occupancy state. In one embodiment, when the vehicle occupant selects a high occupancy state, the controller 44 causes a bit, flag, or other indicator to be stored in memory 46. For example, within the transponder information stored in the memory 46, a field or bit may be reserved for "high occupancy status". On detecting the selection of high occupancy state through the selection device 50, the controller 44 may be configured to set a bit or other indicator within the designated field indicating that the vehicle occupant is claiming to be entitled to high occupancy toll rates. In another embodiment, the current setting of the selection device 50 may be polled or read at a time when the transponder 20 is responding to a read operation from a reader.

In a subsequent read operation by a roadside reader, the transponder information sent in a response signal includes the stored bit or flag indicative of the high occupancy claim. The bit or flag within the response signal may be present due to the storage of the bit or flag by the controller 44 within the transponder information stored in memory 46. In another embodiment, the bit or flag is inserted within response signal (possibly within the transponder information read from memory 46) as a result of polling or reading the setting of the selection device 50 at the time the transponder 20 generates the response signal. In yet another embodiment, the response signal indicates the occupancy status claimed based on the polarization of its signal, as described in U.S. Pat. No. 7,388,501.

The reader 17 receives the response signal including the high occupancy claim from the transponder 20. As a result, it may record the fact that the transponder 20 has made the high occupancy claim. If the reader 17 and/or roadside controller 30 is responsible for initiating/conducting a toll transaction with the transponder 20, then it may process the payment at a reduced rate as a result of the high occupancy claim.

It will be appreciated that the described ETC system relies upon the user's honesty in reporting his or her occupancy status. It may be tempting for a user to claim high occupancy status in order to pay a reduced toll rate in circumstances under which the user is not so entitled. With a conventional high occupancy lane on a roadway, enforcement personnel, such as police, may identify the vehicles claiming to be in high occupancy state based on the fact that the vehicle is travelling in a high occupancy lane. In some embodiments of the present application, the high occupancy toll may apply to any vehicle in any lane provided that the vehicle transponder has reported a high occupancy state. Accordingly, it would be advantageous to provide mechanisms to verify or discover whether a vehicle has claimed a high occupancy state for the purposes of enforcement.

Accordingly, the memory 46 may include a field, bit value, or other portion dedicated to recording whether the driver has recently claimed high occupancy status. In other words, in one embodiment, a bit or other indicator in memory would indicate whether the vehicle claimed to be a high occupancy at the most recent toll transaction. In this manner, enforcement personnel may determine whether the vehicle claimed high occupancy status during a most recent toll transaction. Otherwise, a vehicle occupant could switch his or her occupancy state to normal very shortly after passing a toll area in which a payment was processed.

The reader 17 and/or roadside controller 30 may be configured to include a high occupancy claim indicator in a programming signal sent to the transponder 20 regarding a toll transaction, if the toll transaction is being conducted based on a claim to high occupancy status received from the transponder 20. In this regard, the transponder 20 is notified in the programming signal that its occupancy status claim was received and is being relied upon in a toll transaction. The transponder 20 may then record the high occupancy claim indicator in memory. In one embodiment, the programming signal, which instructs the transponder 20 to update the transponder information stored in memory, causes the transponder 20 to set the high occupancy claim indicator bit or flag within its memory. In some embodiments, the high occupancy indicator is contained within a field in the transponder information stored in the transponder memory.

Enforcement personnel may use portable readers, such as handheld readers, to read transponder information from vehicles travelling in the roadway. The enforcement personnel may then visually verify whether the vehicle is high occupancy or not and take enforcement measures, if necessary. Accordingly, the transponder 20 may be configured to record the high occupancy claim indicator within the transponder information field in its memory. In this manner, a handheld reader (or indeed any reader) will discover whether the high occupancy claim indicator is set using a trigger-read operation.

When recording the high occupancy claim indicator, the transponder 20 may also record a time stamp indicating when the claim was made to high occupancy status.

In some embodiments the occupancy state selected by the user is also recorded in the transponder information. A time stamp may also be recorded in connection with this information, indicating the time at which the user activated the selection device to set the occupancy state to "high". This information may be useful from an enforcement perspective and/or for auditing purposes. For example, in a dispute over whether a vehicle was entitled to claim high occupancy status, it may be helpful to know whether the vehicle occupant selected high occupancy status immediately prior to the most recent toll transaction or whether it had been set a significantly long time earlier.

The transponder 20 may also be configured to automatically deselect "high occupancy state" and return to a "normal" state under certain conditions. For example, after a preset length of time, such as an hour, three hours, a day, etc., the transponder 20 may assume that the high occupancy state is likely no longer valid and may return to a normal state. The user would be required to reset the status as "high occupancy" prior to the next toll transaction if the user is still entitled to claim high occupancy status. The transponder 20 may also be configured to return to a normal status each time it exits a toll highway.

In order to encourage a user to report his or her status correctly, the transponder 20 may be configured to provide a distinctive audio and/or visual output via the visual output device 54 or speaker 52 when the user selects a high occupancy state. In another embodiment, the transponder 20 may be configured to output a distinctive tone or other sound and/or a distinctive visual indicator when a toll transaction is completed at a high occupancy rate verses a normal rate. In this latter case, when a programming signal is received that indicates a toll transaction, the transponder 20 may be configured to output the distinctive tone or visual indicator if the programming signal includes a high occupancy claim indicator.

Figure 3:
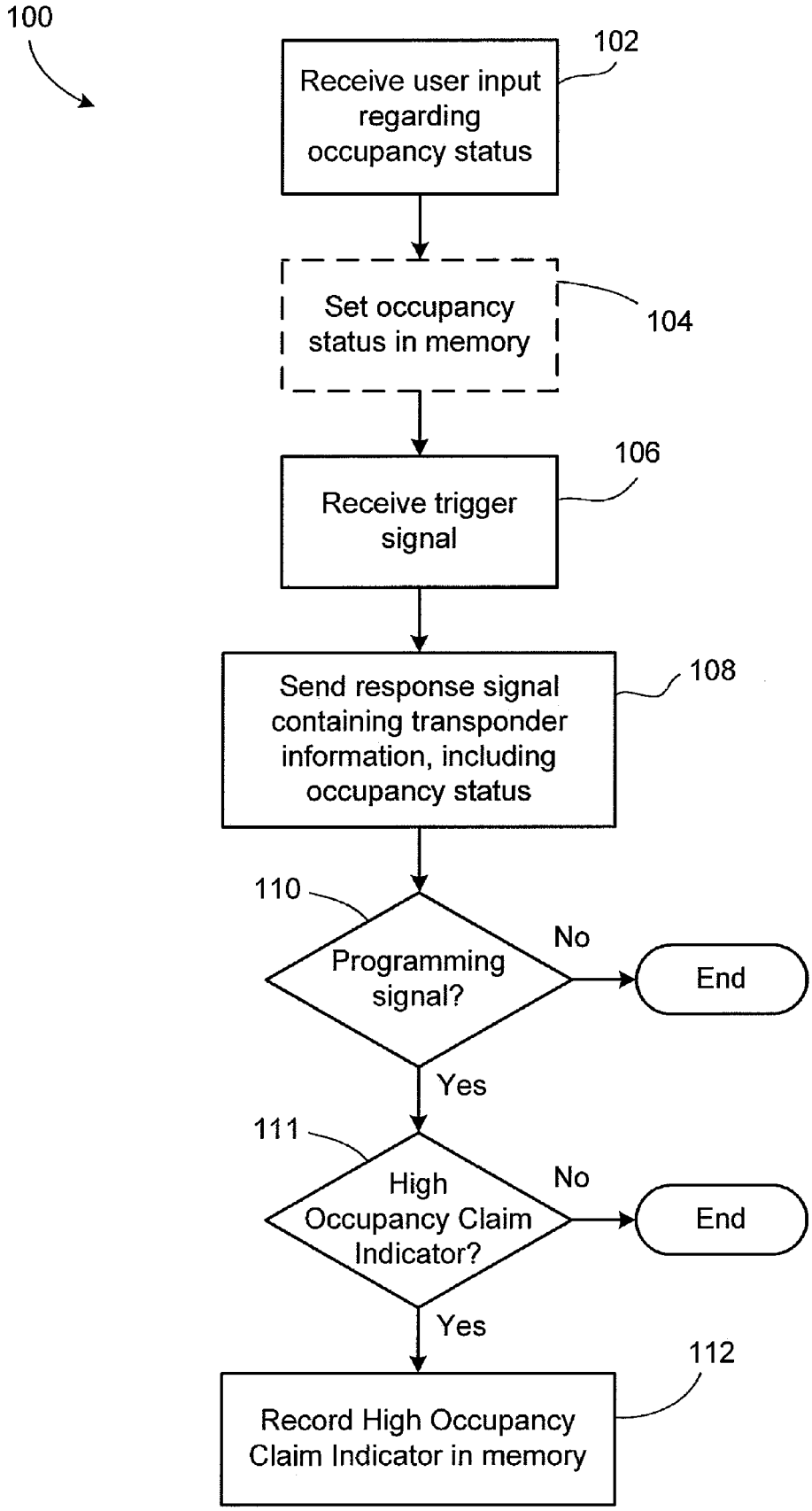
FIG. 3 shows, in flowchart form, an example method of communicating high occupancy status between a vehicle and a remote reader.

Reference is now made to FIG. 3, which shows, in flowchart form a method 100 for communicating high occupancy status between a vehicle and a roadside reader. The method 100 begins in step 102 with receipt of a user input regarding the occupancy state of an associated vehicle. As noted above, the user input may be received through a selection switch, button, or other device. In one embodiment, the selection device is a switch or button integral with the transponder. In another embodiment, the selection switch is a button or switch on the steering wheel or dashboard of the vehicle that causes the vehicle information system to transmit or send a signal to the transponder 20 through a wired or wireless connection, wherein the signal indicates the selected status.

Having received the user input choosing an occupancy status, in some embodiments the transponder sets the occupancy state in memory in step 104. In some embodiments, the occupancy status is a bit or other flag within the transponder information section of the transponder memory. For example, the bit or flag may be set to zero for normal status and may be set to one for high occupancy status. Step 104 is shown in dashed lines since, in some embodiments, step 104 may be omitted, and the state of the selection switch, buttons or other device is polled/read when generating/creating the response signal, as mentioned below.

In step 106, the transponder receives a trigger signal from a reader or portable reader. This may occur, for example, if the transponder 20 enters a coverage area of a reader as the vehicle travels the toll highway. The coverage areas are typically located at ingress or egress points on the highway. In response to the trigger signal, the transponder creates and sends a response signal in step 108. The response signal contains the transponder information stored in the transponder memory. The transponder information sent in the response signal includes the occupancy state recorded in step 104. In some embodiments, step 108 includes reading the status/setting of the selection switch or other device to determine the user's currently claimed occupancy status, and, if necessary, modifying the response signal to include the current claimed occupancy status. The current claimed occupancy status may be a bit or other information within the transponder information or in addition to the transponder information.

In step 110, the transponder evaluates whether it has received a write command (e.g., programming signal) from the roadside reader. As noted above, a programming signal may be received when entering the roadway, in order to record the time and an identifier for the entry point. A programming signal may also be received when exiting the tolled portion of the roadway to record the exit point, confirm toll payment, or otherwise indicate to the transponder that a toll transaction has taken place. In step 111, the transponder may determine whether the programming signal contains a high occupancy claim indicator. If so, then the transponder may record the high occupancy claim indicator in its memory in step 112. By recording the high occupancy claim indicator, the transponder 20 preserves evidence that the vehicle occupants claimed high occupancy status at a recent toll transaction.

It will be understood that steps 110, 111, and 112 may be implemented by receiving a programming signal and recording the transponder information contained in the programming signal. If the transponder information includes a high occupancy claim indicator, then it will be recorded when the transponder information is stored in memory by the transponder. In such an embodiment, the transponder does not strictly perform a step of searching the programming signal for the high occupancy claim indicator in step 111.

It will also be appreciated that in some embodiments, the transponder may actively determine whether the programming signal contains transponder information having a high occupancy claim indicator since the transponder may provide an audio or visual output to the vehicle occupants to confirm that a high occupancy toll transaction occurred.

The high occupancy claim indicator stored in the transponder memory may be a bit or flag within a field in the transponder information.

A person of ordinary skill in the art will appreciate that various additional steps may be performed in the method 100. Some of the steps outlined above may be performed in a different sequence or contemporaneously, depending on the specific application.

Figure 4:
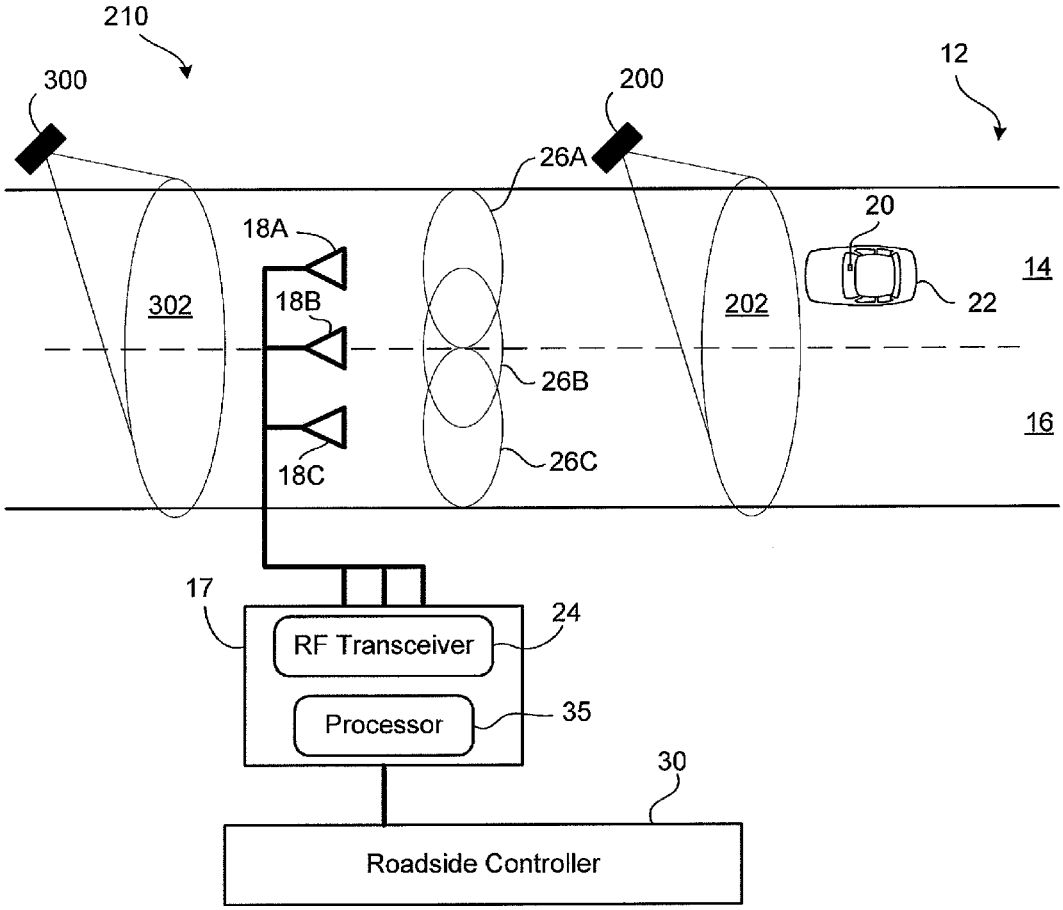
FIG. 4 shows a block diagram of an alternative embodiment of the ETC system.

Reference is now made to FIG. 4, which shows a block diagram of a further embodiment of an electronic toll collection system 210. The electronic toll collection system 210 is similar to the electronic toll collection system 10 shown in FIG. 1. However, the electronic toll collection system 210 of FIG. 4 is configured to remind a vehicle occupant to set his or her occupancy status in advance of an upcoming toll collection zone.

The electronic toll collection system 210 includes a pre-tolling reader 200. The pre-tolling reader 200 has an antenna and placement so as to define a coverage zone 202 spanning all lanes of the roadway 12. The pre-tolling reader 200 broadcasts a trigger or wakeup signal. Transponders 20 within the coverage area 202 of the pre-tolling reader 200 receive the trigger or wakeup signal and respond with a response signal containing their transponder information. The pre-tolling reader 200 informs the transponders 20 that there is an upcoming toll zone. The manner in which the pre-tolling reader 200 informs the transponders 20 of the upcoming toll area may be implemented in a number of ways. For example, the wakeup or trigger signal broadcast by the pre-tolling reader 200 may include a special flag, frequency, or other indicator informing the transponder 20 that this trigger or wakeup signal is from a pre-tolling reader 200. In one embodiment, the pre-tolling reader 200 may send a signal or other communication within the guard band normally found following a trigger or wakeup signal and before a transponder response signal. The transponders 20 may be configured to listen for the pre-tolling reader signal within the guard band while preparing its response signal. If a pre-tolling reader signal is detected in the guard band, then the transponder 20 need not send a response signal and is thereby notified of an upcoming toll zone. If no signal is detected in the guard band, then the transponder 20 assumes it is a normal reader trigger signal and it responds accordingly.

In another embodiment, the pre-tolling reader 200 may send a programming signal containing a flag, bit, or other indicator notifying the transponder 20 that it has entered a pre-tolling warning zone. Other possibilities for communicating to the transponder 20 the fact that it is in communication with a pre-tolling reader 200 instead of a normal reader will be apparent to those of ordinary skill in the art.

Irrespective of how the transponder 20 is informed that it is in communication with a pre-tolling reader 200, it may then alert the vehicle occupant to the upcoming toll zone. For example, the transponder 20 may output a distinctive sound, such as a warning beep or set of tones. Additionally or alternatively, the transponder may output a distinctive visual display, such as a flashing set or pattern of LEDs. Any other auditory or visual outputs that serve to draw the vehicle occupant's attention to the transponder 20 may also be used. In some embodiments, the alert may depend on the current state of the occupancy selection device. For example, the alert may only be output if the occupancy state is set to high occupancy. Alternatively it may only be output if it is set to low occupancy. In another embodiment, the alert may be different for low and high occupancy. In many such cases, the intention of the warning outputs from the transponder 20 is to remind the user to select the appropriate occupancy state because of the upcoming toll zone.

The pre-tolling reader 200 and coverage zone 202 are placed a distance 304 from the coverage areas 26 of the toll transaction zone. The distance 304 should be sufficiently long to enable a user to comfortably assess the vehicle's occupancy status and make the appropriate selection.

Referring still to FIG. 4, the system 210 may include a post-tolling reader 300 and coverage zone 302. The post-tolling reader 300 and coverage zone 302 may be configured to read the transponder information and, in particular, the high occupancy claim indicator. A high occupancy claim indicator present in a transponder memory may trigger the system 210 to illuminate a strobe light or other visual indicator that signals that a passing vehicle has claimed high occupancy status. This post-tolling visual indication would assist enforcement personnel in identifying those vehicles that may have wrongfully claimed high occupancy status. The post-tolling reader 300 and coverage zone 302 is illustrated as a wide area embodiment; however it will be appreciated that individual antennas and readers specific to individual lanes may be used in other embodiments.

In a further embodiment the post-tolling reader 300 may be connected to an imaging system (not illustrated). When a high occupancy claim indicator is detected, the imaging system may capture an image of the vehicle and/or its occupants, to enable verification of the occupancy status of the vehicle.

In embodiments in which the post-tolling reader 300 and coverage zone 302 closely follow the antennas 18, the lane assignment determined by the reader 17 and/or controller 30 may be relied upon for identifying which vehicle traversing the coverage zone 302 is associated with the high occupancy claim indicator, since the reader 17 and/or controller 30 are aware of the association between particular transponder identification and lane assignments.

In yet another embodiment, the imaging system and/or visual indicators (e.g. strobes) may be incorporated into the ETC system 210 and the strobes may be mounted or placed on or near the gantry spanning the roadway 12 and associated with the individual lanes. In this embodiment, the reader 17 is already aware of whether a high occupancy claim has been indicated by the transponder 20 and need not perform a further read of the transponder 20. After verifying that the transponder memory has been correctly updated in response to the programming signal, the reader 17 may illuminate the visual indicator corresponding to the transponder's 20 lane assignment and/or trigger the imaging system to capture an image of the vehicle and/or its occupants.

Figure 5:
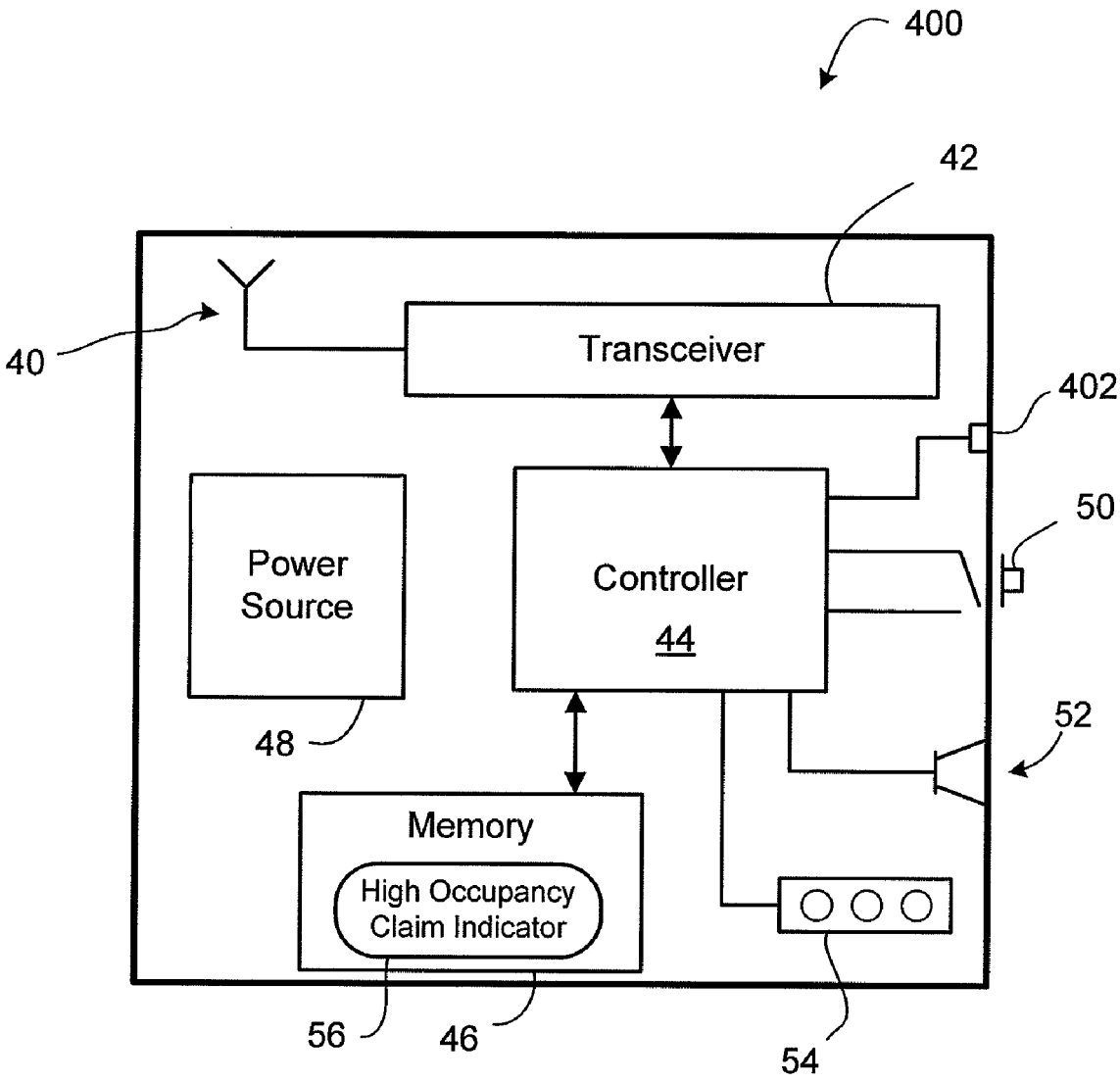
FIG. 5 shows another embodiment of a transponder for use in the ETC system.

Reference is now made to FIG. 5, which shows another embodiment of a transponder 400 in accordance with the present application. In this embodiment, the transponder 400 includes an occupancy signal input port 402 in addition to, or as an alternative to, the selection device 50. The occupancy signal input port 402 is configured to receive an occupancy signal from an external in-vehicle source. The occupancy signal is indicative of the occupancy status of the vehicle. Accordingly, the transponder 400 (in particular, the controller 44) may rely on the occupancy signal from the occupancy signal input port 402 to select between normal or high occupancy state. In other words, if the occupancy signal is indicative of a high occupancy state, the controller may set the bit, flag, or other indicator corresponding to a high occupancy state.

Example in-vehicle sources from which an occupancy status signal may be received include any human presence detection mechanism. For example, the in-vehicle source may include seat pressure transducers, seat belt sensors, CO2 sensors, visible wavelength camera(s), IR camera(s), passive millimetre wave detector(s), and any other suitable devices for detecting the presence of humans and, more particularly, detecting the number of humans present. It will be appreciated that, in some instances, the presence detection system/device may be incorporated into the vehicle and the occupancy status signal may be obtained from the vehicle information system, e.g. from an on-board diagnostics port. The precise ranges of suitable devices and/or their configuration will be appreciated by those of ordinary skill in the art.

The occupancy status indicated by the occupancy signal may be used to set the occupancy state. The selection device 50, if present, may then be used to override that state. This may be suitable if the presence detection system is not capable of detecting the presence of some occupants, such as infants or small children, or under other circumstances. For example, a false high occupancy state may be set if seat pressure transducers respond to heavy items placed on a seat, and a selection device would permit the vehicle occupant to correct the state.

In another embodiment, the occupant may still be required to set the occupancy state using the selection device 50 and the occupancy signal may only be used as a verifier. If the occupancy signal indicates an occupancy state different from the selection device 50 this difference may be noted or indicated in a discrepancy flag the transponder memory, and this flag may cause the reader 17 to signal an enforcement system.

Other variations will be appreciated by those ordinarily skilled in the art.

Although example embodiments above refer to a reader 17 (FIG. 1) and/or a roadside controller 30 (FIG. 1), some described functions of these devices may be implemented by the other. In some embodiments, the reader and roadside controller are implemented as a signal unit, which may be generically termed a "reader". In general, the term "reader" will be understood to refer to the transceiver, antennas, processor and other components implementing RF-based communications with vehicle-borne transponders and, in some cases, includes toll transaction processing.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An electronic toll collection transponder for use in an electronic toll collection system for communicating high occupancy status to a reader, the transponder comprising:

a controller;

a memory storing transponder information;

a selection device operable by a user to select a high occupancy state; and a transceiver and antenna configured to, under control of the controller, receive a trigger signal, send a response signal to the reader in reply to the trigger signal, and receive a programming signal, wherein the response signal includes the transponder information and includes the high occupancy state selected via the selection device, and wherein the controller is configured to record a high occupancy claim indicator in the memory evidencing that the transponder claimed high occupancy state if the programming signal includes the high occupancy claim indicator.

2. The electronic toll collection transponder claimed in claim 1, further including an output device for generating audio or visual output under the control of the controller, and wherein the controller is configured to cause the output device to output an audio or visual signal on receipt of a programming signal without the high occupancy claim indicator and to output a different audio or visual signal on receipt of the programming signal containing the high occupancy claim indicator.

3. The electronic toll collection transponder claimed in claim 1, further including an output device for generating audio or visual output under the control of the controller, and wherein the controller is further configured to detect a pre-tolling signal from a roadside pre-tolling reader and, in response to the pre-tolling signal, cause a warning signal to be output through the output device.

4. The electronic toll collection transponder claimed in claim 1, wherein the controller is further configured to record the high occupancy state within the transponder information stored in memory on detecting selection of the high occupancy state via the selection device.

5. The electronic toll collection transponder claimed in claim 1, wherein the controller is further configured to determine the occupancy state set via the selection device in response to receipt of the trigger signal, to read the transponder information stored in memory, to modify the transponder information to include the occupancy state set via the selection device, and to generate the response signal containing the modified transponder information.

6. The electronic toll collection transponder claimed in claim 1, wherein the programming signal contains updated transponder information, and wherein the controller is configured to overwrite the transponder information stored in the memory with the updated transponder information received in the programming signal, and wherein the updated transponder information includes the high occupancy claim indicator.

7. A method of communicating high occupancy status between a vehicle and a reader of an electronic toll collection system, the method comprising:

receiving an input selecting a high occupancy state via a selection device;

receiving a trigger signal from the roadside reader and sending a response signal to the roadside reader, wherein the response signal includes transponder information and the high occupancy state selected via the selection device;

receiving a programming signal, wherein the programming signal includes a high occupancy claim indicator; and recording the high occupancy claim indicator in memory evidencing that the transponder claimed the high occupancy state.

8. The method claimed in claim 7, further including outputting an audio or visual signal within the vehicle in response to receipt of the user input selecting the high occupancy state.

9. The method claimed in claim 7, further including outputting an audio or visual signal within the vehicle on receipt of a programming signal without the high occupancy claim indicator, and outputting a different audio or visual signal within the vehicle on receipt of the programming signal containing the high occupancy claim indicator.

10. The method claimed in claim 7, further including receiving a signal from a roadside pre-tolling reader, and outputting an audio or visual warning signal within the vehicle in response to the signal from the roadside pre-tolling reader.

11. The method claimed in claim 7, further comprising detecting selection of the high occupancy state via the selection device and, in response to the detection, recording the high occupancy state within the transponder information stored in memory.

12. The method claimed in claim 7, further comprising determining the occupancy state set by via the selection device in response to receipt of the trigger signal, reading the transponder information stored in memory, modifying the transponder information to include the occupancy state set via the selection device, and generating the response signal containing the modified transponder information.

13. The method claimed in claim 7, wherein the programming signal contains updated transponder information, and wherein recording comprises overwriting the transponder information stored in the memory with the updated transponder information received in the programming signal, and wherein the updated transponder information includes the high occupancy claim indicator.

14. The method claimed in claim 7, further including subsequent steps of receiving a subsequent trigger signal from an enforcement reader, and sending a subsequent response signal from the transponder to the enforcement reader, and wherein the subsequent response signal includes the transponder information, including the high occupancy claim indicator.

15. An electronic toll collection system for performing differentiated tolling for vehicles within a roadway, the system comprising:

a reader, including a plurality of antennas defining a capture zone within the roadway, an RF transceiver, and a toll transaction processor for conducting electronic toll collection transactions; and a transponder, including a controller, a memory storing transponder information, a selection device operable by a user to select a high occupancy state, and a transceiver and antenna configured to, under control of the controller, receive a trigger signal, send a response signal to the reader in reply to the trigger signal, and receive a programming signal, wherein the response signal includes the transponder information and includes the high occupancy state selected via the selection device, wherein the reader is configured to generate the programming signal containing updated transponder information, the updated transponder information including a high occupancy indicator based on the high occupancy state in the response signal, and wherein the controller is configured to overwrite the transponder information in memory with the updated transponder information received in the programming signal, thereby storing the high occupancy claim indicator.

16. The electronic toll collection system claimed in claim 15, further including an output device for generating audio or visual output under the control of the controller, and wherein the controller is further configured to detect a pre-tolling signal from a roadside pre-tolling reader and, in response to the pre-tolling signal, cause a warning signal to be output through the output device.

17. The electronic toll collection system claimed in claim 15, further including an output device for generating audio or visual output under the control of the controller, and wherein the controller is configured to cause the output device to output an audio or visual signal on receipt of a programming signal without the high occupancy claim indicator and to output a different audio or visual signal on receipt of the programming signal containing the high occupancy claim indicator.

18. An electronic toll collection reader for performing differentiated tolling for vehicles within a roadway, each vehicle having a transponder storing transponder information and being configured to send a response signal containing the transponder information and a high occupancy status, the reader-comprising:

a transceiver;

one or more antennas for sending and receiving RF signals under the controller of the transceiver and defining a capture zone within the roadway; and a processor for controlling the transceiver, wherein the processor is configured to cause the transceiver to transmit a trigger signal within the capture zone, receive the response signal in reply to the trigger signal, detect the high occupancy status within the transponder information in the response signal, initiate a toll transaction, generate updated transponder information including a high occupancy claim indicator, and cause the transceiver to transmit a programming signal containing the updated transponder information.

19. A method of conducting differentiated tolling for vehicles within a roadway, each vehicle having a transponder storing transponder information and being configured to send a response signal containing the transponder information and a high occupancy status when in a capture zone of a toll area, the toll area having a reader including antennas defining the capture zone, the method comprising:

transmitting a trigger signal within the capture zone;

receiving the response signal from the transponder in reply to the trigger signal;

detecting the high occupancy status within the transponder information in the response signal;

initiating a toll transaction;

generating updated transponder information including a high occupancy claim indicator; and transmitting a programming signal to the transponder containing the updated transponder information.

20. The method claimed in claim 19, further including overwriting the transponder information with the updated transponder information within the memory of the transponder.

* * * * *